US007063755B2

(12) United States Patent
Nolan

(10) Patent No.: US 7,063,755 B2
(45) Date of Patent: Jun. 20, 2006

(54) METHOD FOR LASER ANNEALING

(75) Inventor: Stephen R Nolan, Windsor (CA)

(73) Assignee: General Motors Corporation, Detroit, MI (US)

( * ) Notice: Subject to any disclaimer, the term of this patent is extended or adjusted under 35 U.S.C. 154(b) by 231 days.

(21) Appl. No.: 10/644,348

(22) Filed: Aug. 20, 2003

(65) Prior Publication Data

US 2005/0039828 A1 Feb. 24, 2005

(51) Int. Cl.
*C22F 1/04* (2006.01)

(52) U.S. Cl. ..... 148/565

(58) Field of Classification Search ..... 148/525, 148/565

See application file for complete search history.

(56) References Cited

U.S. PATENT DOCUMENTS 3,848,104 A * 11/1974 Locke ..... 219/121.65
4,459,458 A * 7/1984 Vetsch et al. ..... 219/121.6
4,879,448 A * 11/1989 Folger et al. ..... 219/121.63
5,859,405 A * 1/1999 Golz et al. ..... 219/121.67
6,350,326 B1 * 2/2002 McCay et al. ..... 148/503

FOREIGN PATENT DOCUMENTS

JP 2000-42765 A * 2/2000
SU 1806884 A1 * 4/1993

* cited by examiner

*Primary Examiner*—George Wyszomierski
(74) *Attorney, Agent, or Firm*—Laura C. Hargitt

(57) ABSTRACT

A method for laser annealing a part includes the steps of providing automated tooling, providing a laser, and providing a metal part to be annealed. The method also includes the steps of moving either one of the laser or metal part by the automated tooling relative to a stationary one of the other laser or metal part. The method further includes the steps of supplying power to the laser to heat a portion of the metal part to a predetermined temperature to anneal the portion of the metal part as the laser and metal part move relative to each other.

16 Claims, 2 Drawing Sheets

METHOD FOR LASER ANNEALING

TECHNICAL FIELD

The present invention relates generally to annealing and, more particularly, to a method for laser annealing a metal part for assembling automotive structures.

BACKGROUND OF THE INVENTION

Metal parts such as aluminum sheet panels are becoming increasingly popular in recent automotive body applications. For examples aluminum sheet panels are used for a closure panel assembly. The closure panel assembly typically includes an outer skin or panel with a generally perpendicular upstanding flange of about ten millimeters (10 mm) in height and an inner section or sheet panel completing the assembly. The closure panel assembly is pressed together in tooling known as a hemmer where the upstanding flange of the outer sheet panel is pressed down onto the inner sheet panel, thereby locking the panels together with a tightness prescribed by a product tolerance.

During vehicle body manufacturing, such aluminum sheet panels, particularly those about one millimeter (1 mm) in thickness, are formed into various shapes using a stamping process. However, through the shaping of the aluminum in the stamping process, the sheet panels are work hardened. The pressing down on the upstanding flange by the hemmer rotates the flange through about a ninety degree (90°) movement and the radius of this bend (5 mm) experiences stress cracks. Therefore, sections of the aluminum parts need to be annealed prior to the hemming process. Particularly, the radius of the upstanding flange around the perimeter of the outer sheet panel. The annealing of this area alleviates stress cracking in the final manufacturing.

Currently, an induction heating system is used to anneal the outer sheet panel. The induction system uses at least one electrical coil element that is formed to the outer perimeter of the outer sheet panel. An operator is used to load and unload the outer sheet panel into the induction system. An induction current is passed through the coil element to heat up the whole outer perimeter at once, which causes dimensional instability or distortion of the outer sheet panel. The distortion comes from the heat applied by the induction heating system all at once around the whole outer perimeter of the outer sheet panel. Further, because only three sides of the outer sheet panel are annealed to eliminate the distortion, the side not annealed is subject to stress cracking. In addition, if induction heating is used to do portions of the outer sheet panel at a time, separate induction cycles after cooling of the previous sections are not economical due to cycle time. Further, expensive tape is wrapped around the coil element to prevent the outer sheet panel from touching them, which needs to be changed on a daily basis, increasing maintenance costs and user intervention.

As a result, it is desirable to provide a method for laser annealing metal parts for automotive structures. It is also desirable to provide a method for laser annealing of aluminum sheet panels for a closure panel assembly, which prevents distortion of the assembly. It is further desirable to provide a method for laser annealing of aluminum hems in automotive closure components to enhance the bendability of the material during helming. Therefore, there is a need in the art to provide a method for laser annealing that meets these desires.

SUMMARY OF THE INVENTION

It is, therefore, one object of the present invention to provide a method for laser annealing metal parts.

It is another object of the present invention to provide a method for laser annealing of an aluminum sheet panel in an automotive closure panel assembly.

To achieve the foregoing objects, the present invention is a method for laser annealing a part. The method includes the steps of providing automated tooling, providing a laser, and providing a metal part to be annealed. The method also includes the steps of moving either one of the laser or metal part by the automated tooling relative to a stationary one of the other laser or metal part. The method further includes the steps of supplying power to the laser to heat a portion of the metal part to a predetermined temperature to anneal the portion of the metal part as the laser and metal part move relative to each other.

One advantage of the present invention is that a method for laser annealing a metal part is provided for automotive structures. Another advantage of the present invention is that the method allows laser annealing of aluminum hems in automotive closure components to enhance the bendability of the material during hemming. Yet another advantage of the present invention is that the method uses a laser, which can heat up a small area at a time and cool the trailing spot with additional tooling, thereby preventing distortion of the metal part. Still another advantage of the present invention is that the method allows annealing of aluminum closure sheet panels before a hemming process to alleviate stress cracking. A further advantage of the present invention is that the method has full perimeter annealing capabilities. Yet a further advantage of the present invention is that the method provides decreased cycle time and eliminates operator intervention. Still a further advantage of the present invention is that the method reduces maintenance costs as compared to conventional induction annealing.

Other objects, features, and advantages of the present invention will be readily appreciated, as the same becomes better understood, after reading the subsequent description taken in conjunction with the accompanying drawings.

DESCRIPTION OF THE PREFERRED EMBODIMENT

Figure 1:
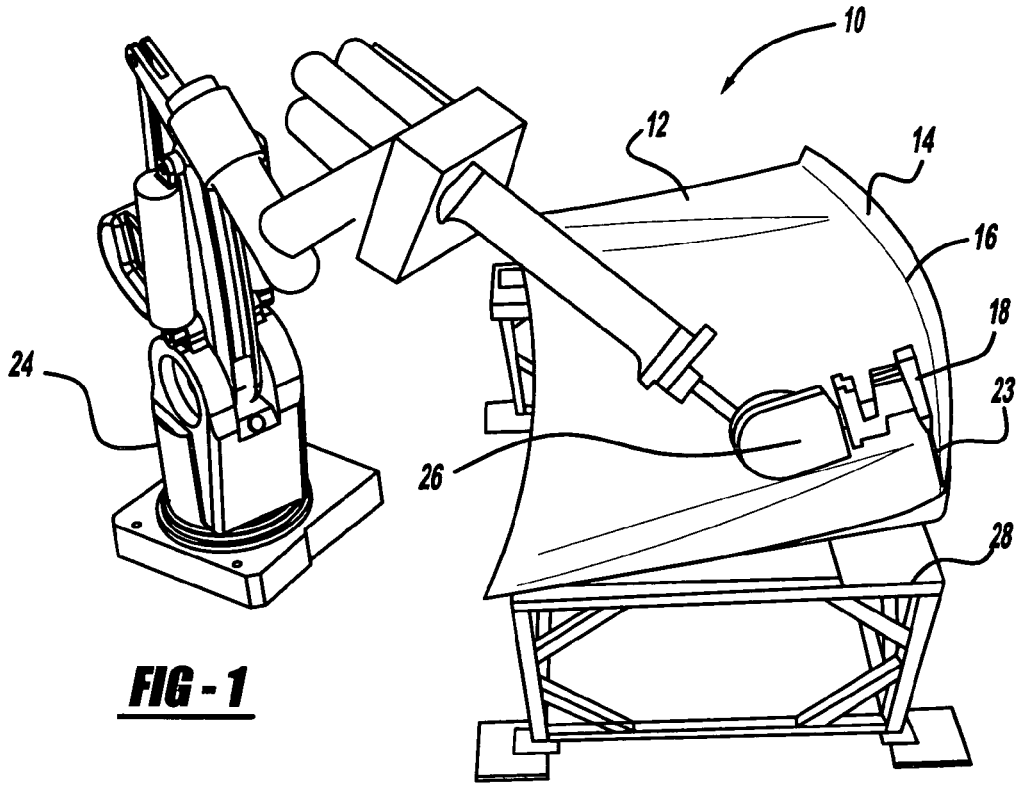
FIG. 1 is a perspective view of a system for use with a method, according to the present invention, for laser annealing illustrated in operational relationship with a closure sheet panel and a robot.

Referring to the drawings and in particular FIG. 1, one embodiment of a system 10 for carrying out a method, according to the present invention, for laser annealing a metal part such as a sheet panel 12 is illustrated. By way of example, the sheet panel 12 may be an outer sheet panel for a closure panel assembly such as a liftgate of a vehicle (not shown). It should be appreciated that the system 10 anneals the sheet panel 12 prior to hemming in a hemmer (not shown).

The sheet panel 12 is generally planar and made of a metal material such as aluminum. The sheet panel 12 has an upstanding flange 14 extending generally perpendicular to a remainder thereof. The upstanding flange 14 has a predetermined height such as approximately ten millimeters (10 mm). The sheet panel 12 also has a radius of curvature or radial bend 16 between the upstanding flange 14 and the remainder of the sheet panel 12. The radial bend 16 has a predetermined length such as approximately five millimeters (5 mm). The sheet panel 12 has a thickness in a range of approximately one millimeter (1.0 mm) to approximately three millimeters (3.0 mm). It should be appreciated that the sheet panel 12 is conventional and known in the art.

Figure 2:
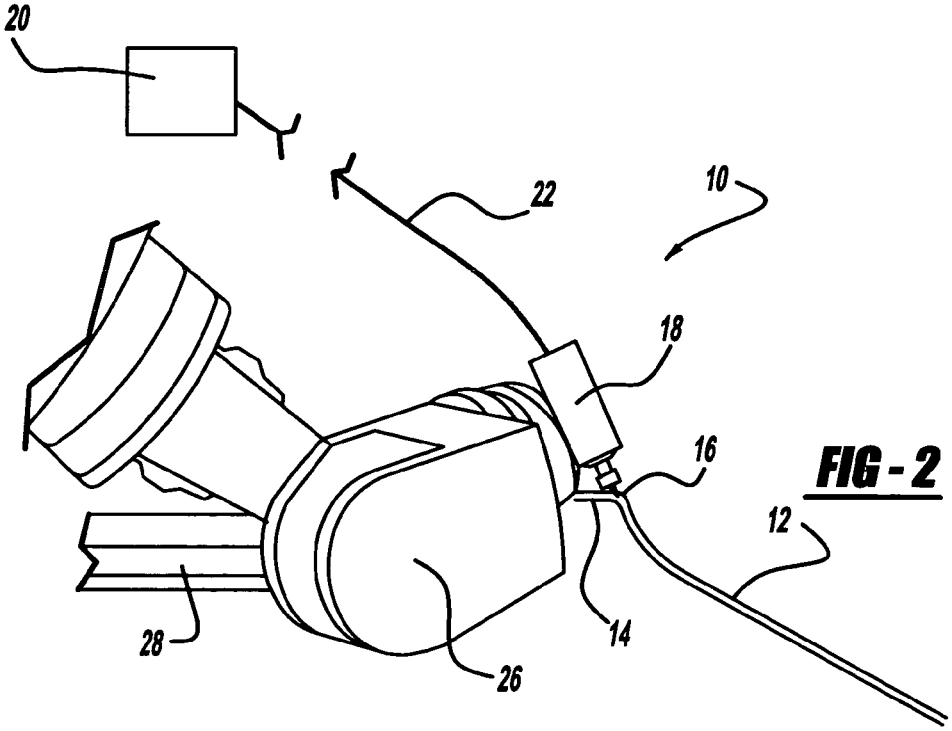
FIG. 2 is an elevational view of the system of FIG. 1 for use in the method for laser annealing.
Figure 3:
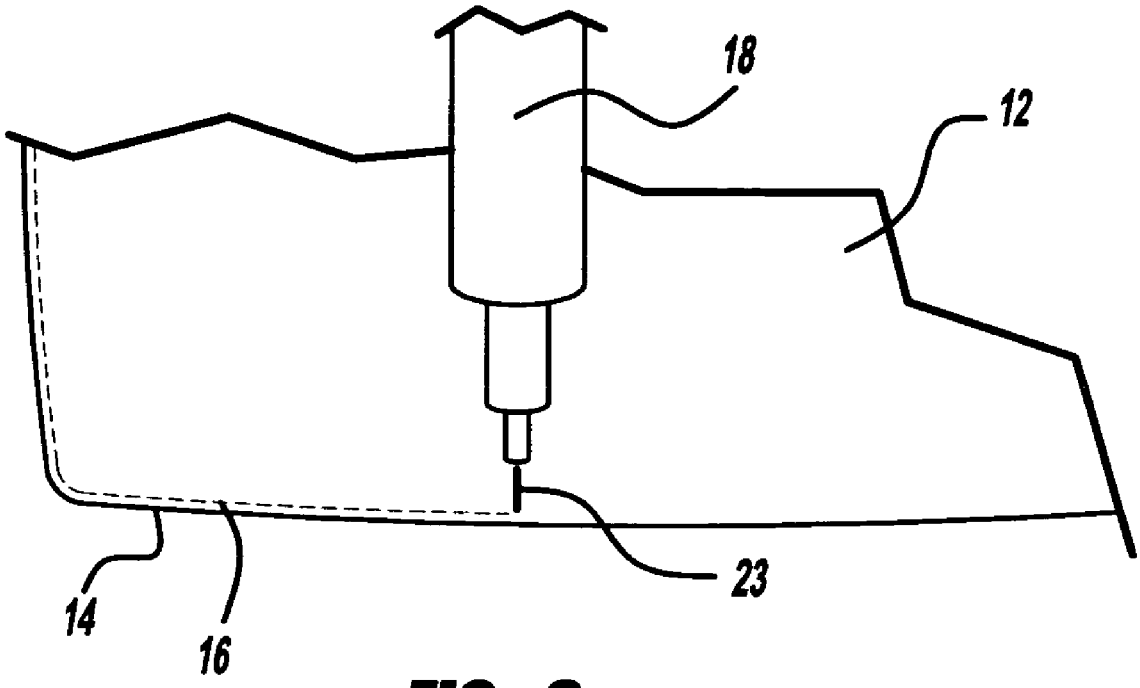
FIG. 3 is a plan view of a portion of the system of FIG. 2 for use in the method for laser annealing.

Referring to FIGS. 1 through 3, the system 10 includes a laser 18 to anneal the sheet panel 12. In the embodiment illustrated, the laser 18 heats the radial bend 16 to a predetermined or annealing temperature such as approximately seven hundred fifty degrees (750° F.) to anneal the aluminum material of the radial bend 16 to reduce or eliminate a potential for cracking during the hemming process. The system 10 also includes a laser power supply 20 electrically connected to the laser 18 by either a fiber optic cable or wire 22. The laser power supply 20 supplies power to the laser 18 via the wire 22 to emit a laser beam 23 to heat the radial bend 16 prior to bending. It should be appreciated that the laser 18 operates at a predetermined power output. It should also be appreciated that the laser 18 may be a focusing head with the laser beam 23 fed to it by the fiber optic cable 22.

The system 10 further includes automated tooling such as a robot 24 to carry or move either the laser 18 or the sheet panel 12. In the embodiment illustrated in FIGS. 1 through 3, the robot 24 is fixed to a support surface and has a movable arm 26, which carries the laser 18. The sheet 12 is held stationary by a fixture 28 supported by the support surface. The robot 24 moves the movable arm 26 and the laser 18 at a predetermined speed to move the laser beam 23 along the radial bend 16 to heat and anneal the aluminum material of the radial bend 16. The robot 24, carrying the laser 18, is electrically connected to a controller (not shown) and can be programmed to move the movable arm 24 at variable speeds around the fixtured or stationary sheet panel 12. In another embodiment, the laser 18 is fixed or stationary and is held by a pedestal (not shown) or the fixture 28. In this embodiment, the movable arm 26 of the robot 24 carries or moves the sheet panel 12 relative to the laser 18. It should be appreciated that a combination of the power output of the laser 18 and the speed of the movable arm 26 of the robot 24 can heat an area in question or radial bend 16 to the annealing temperature needed, for example, 750° F. It should also be appreciated that these two variables can vary by laser type, laser potential power capacities, robot type, and robot speed. It should further be appreciated that the robot 24 can carry the laser 18 itself or a focusing head with the laser beam 23 fed to it by the fiber optic cable 22. It should still further be appreciated that the system 10 focuses the laser beam 23 around the sheet panel 12 at a predetermined speed and power/voltage.

Once the radial bend 16 of the sheet panel 12 has been annealed, the sheet panel 12 and an inner section or sheet panel (not shown) are joined to complete the closure panel assembly. A structural adhesive, which glues the sheet panels together, is then applied to the outer panel sheet 12 prior to being married with the inner sheet panel and then hemmed. The closure panel assembly is pressed together in tooling known as a hemmer where the upstanding flange 14 of the outer sheet panel 16 is pressed down onto the inner sheet panel, thereby locking the panels together with a tightness prescribed by a product tolerance.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

The invention claimed is:

1. A method for laser annealing a part comprising the steps of:

providing automated tooling;

providing a laser;

providing a an aluminum sheet panel having an upstanding flange with a radial bend therebetween to be annealed;

moving either one of the laser or aluminum sheet panel by the automated tooling relative to a stationary one of the other laser or aluminum sheet panel; and;

supplying power to the laser to heat the radial bend of the aluminum sheet panel to a predetermined temperature to anneal the radial bend of the aluminum sheet panel as the laser and aluminum sheet panel move relative to each other.

2. A method as set forth in claim 1 wherein said step of providing the aluminum sheet panel comprises providing an aluminum sheet panel having a thickness of about one millimeter to about three millimeters.

3. A method as set forth in claim 1 wherein said step of providing the aluminum sheet panel comprises providing an aluminum sheet panel having a radial bend of about five millimeters.

4. A method as set forth in claim 1 wherein said step of providing the automated tooling comprises providing a robot with a movable arm.

5. A method as set forth in claim 4 including the step of attaching the laser to the movable arm.

6. A method as set forth in claim 5 wherein said step of moving comprises moving the movable arm and the laser relative to the stationary aluminum sheet panel.

7. A method as set forth in claim 4 including the step of attaching the aluminum sheet panel to the movable arm.

8. A method as set forth in claim 7 wherein said step of moving comprises moving the movable arm and the aluminum sheet panel relative to the stationary laser.

9. A method for laser annealing apart comprising the steps of:

providing a robot having a movable arm;

providing a laser;

providing an aluminum sheet panel having an upstanding flange with a radial bend to be annealed;

moving either one of the laser or aluminum sheet panel by the movable arm of the robot relative to a stationary one of the other laser or aluminum sheet panel; and;

supplying power to the laser to heat the radial bend of the aluminum sheet panel to a predetermined temperature to anneal the radial bend of the aluminum sheet panel as the laser and aluminum sheet panel move relative to each other.

10. A method as set forth in claim 9 wherein said step of providing the aluminum sheet panel comprises providing an aluminum sheet panel having a thickness of about one millimeter to about three millimeters.

11. A method as set forth in claim 9 wherein said step of providing the aluminum sheet panel comprises providing an aluminum sheet panel having the upstanding flange of about 10.0 millimeters and the radial bend of about 5.0 millimeters.

12. A method as set forth in claim 9 including the step of attaching the laser to the movable arm.

13. A method as set forth in claim 12 wherein said step of moving comprises moving the movable arm and the laser relative to the stationary aluminum sheet panel.

14. A method as set forth in claim 9 including the step of attaching the aluminum sheet panel to the movable arm.

15. A method as set forth in claim 14 wherein said step of moving comprises moving the movable arm and the aluminum sheet panel relative to the stationary laser.

16. A method for laser annealing a sheet panel comprising the steps of:

providing a robot having a movable arm;

providing a laser;

providing an aluminum sheet panel having an upstanding flange with a radial bend to be annealed;

attaching either one of the laser or aluminum sheet to the movable arm of the robot and moving the attached laser or aluminum sheet panel relative to a stationary one of the other laser or aluminum sheet panel; and supplying power to the laser to heat the radial bend of the aluminum sheet panel to a predetennined temperature to anneal the radial bend of the aluminum sheet panel as the laser and aluminum sheet panel move relative to each other.

* * * * *